US009224545B2

(12) United States Patent
Ignatov et al.

(10) Patent No.: US 9,224,545 B2
(45) Date of Patent: Dec. 29, 2015

(54) ELECTRIC CONTACTOR WITH FLYWHEEL DRIVE AND METHOD OF SWITCHING AN ELECTRIC CONTACTOR ON AND/OR OFF

(75) Inventors: Andrej Ignatov, Müchen (DE); Robert Kralik, Poing (DE)

(73) Assignee: SCHALTBAU GMBH, Munich (DE)

( * ) Notice: Subject to any disclaimer, the term of this patent is extended or adjusted under 35 U.S.C. 154(b) by 0 days.

(21) Appl. No.: 14/236,031

(22) PCT Filed: Aug. 2, 2012

(86) PCT No.: PCT/EP2012/003308

§ 371 (c)(1), (2), (4) Date: Mar. 27, 2014

(87) PCT Pub. No.: WO2014/005611

PCT Pub. Date: Jan. 9, 2014

(65) Prior Publication Data

US 2015/0042426 A1 Feb. 12, 2015

(30) Foreign Application Priority Data

Jul. 2, 2012 (DE) ..... 10 2012 013170

(51) Int. Cl.
*H01H 3/60* (2006.01)
*H01H 3/40* (2006.01)
(Continued)

(52) U.S. Cl.
CPC . *H01H 3/40* (2013.01); *H01H 1/50* (2013.01); *H01H 3/001* (2013.01); *H01H 3/28* (2013.01); *H01H 50/546* (2013.01); *H01H 50/305* (2013.01)

(58) Field of Classification Search
CPC ..... H01H 3/40; H01H 3/28; H01H 67/02; H01H 62/02; H01H 50/04; H01H 50/30; H01H 50/16; H01H 45/04
USPC ..... 335/193
See application file for complete search history.

(56) References Cited

U.S. PATENT DOCUMENTS 2,476,794 A 7/1949 Austin
3,164,732 A * 1/1965 Molitor ..... 310/37
(Continued)

FOREIGN PATENT DOCUMENTS

DE 1166369 B 3/1964
DE 45149 1/1966
(Continued)

OTHER PUBLICATIONS

German Office Action for Application No. 10 2012 013 170.4 mailed Apr. 11, 2013 (5 pages).
(Continued)

*Primary Examiner* — Shawki S Ismail
*Assistant Examiner* — Lisa Homza
(74) *Attorney, Agent, or Firm* — Kilpatrick Townsend & Stockton LLP

(57) ABSTRACT

Disclosed is an electric contactor, in particular to be used in roadways, with the stator and an armature, the armature being connected with a contact region and being movable, during a switching-on operation and/or a switching-off operation of the contactor, from a first to a second position, the contact region being connected in at least one of these positions with a counter-contact region for closing an electric circuit, wherein a pushing device is connected with the armature which is rotational relative to the armature, wherein the pushing device at least temporarily pushes the armature supportively in the movement from the first to the second position of the switching-on and/or switching-off operation.

10 Claims, 5 Drawing Sheets

(51) Int. Cl.

| | |
|---|---|
| ***H01H 1/50*** | (2006.01) |
| ***H01H 3/00*** | (2006.01) |
| ***H01H 50/54*** | (2006.01) |
| ***H01H 3/28*** | (2006.01) |
| *H01H 50/30* | (2006.01) |

(56) References Cited

U.S. PATENT DOCUMENTS

| | | | | | |
|---|---|---|---|---|---|
| 3,229,170 | A | * | 1/1966 | Daugherty et al. | 335/272 |
| RE25,992 | E | * | 3/1966 | Molitor | 310/37 |
| 3,296,567 | A | * | 1/1967 | Conner et al. | 335/126 |
| 3,331,039 | A | * | 7/1967 | McGary | 335/132 |
| 3,821,671 | A | * | 6/1974 | Grunert et al. | 335/132 |
| 3,964,006 | A | * | 6/1976 | Lacan | 335/132 |
| 4,398,167 | A | * | 8/1983 | Dickie et al. | 335/272 |
| 4,724,349 | A | * | 2/1988 | Grimm et al. | 310/216.114 |
| 5,065,039 | A | * | 11/1991 | Isozumi et al. | 290/48 |
| 5,394,128 | A | * | 2/1995 | Perreira et al. | 335/126 |
| 5,424,700 | A | * | 6/1995 | Santarelli | 335/126 |
| 5,677,656 | A | * | 10/1997 | Mauch et al. | 335/126 |
| 5,703,551 | A | * | 12/1997 | Lefebvre et al. | 335/126 |
| 5,757,256 | A | * | 5/1998 | Vilou | 335/126 |
| 5,892,422 | A | * | 4/1999 | Montaigu et al. | 335/126 |
| 5,909,067 | A | * | 6/1999 | Liadakis | 310/14 |
| 6,049,263 | A | * | 4/2000 | Vilou | 335/126 |
| 8,729,994 | B2 | * | 5/2014 | Willburger et al. | 335/272 |
| 9,082,574 | B2 | * | 7/2015 | Tumback et al. | 335/126 |

FOREIGN PATENT DOCUMENTS

| | | | |
|---|---|---|---|
| EP | 0433551 | A1 | 6/1991 |
| GB | 758782 | A | 10/1956 |

OTHER PUBLICATIONS

International Search Report mailed on Mar. 8, 2013, for PCT Application No. PCT/EP2012/003308 (6 pages).

German Office Action for Application No. 10 2012 013 170.4 mailed Apr. 11, 2013 (3 pages).

* cited by examiner

ELECTRIC CONTACTOR WITH FLYWHEEL DRIVE AND METHOD OF SWITCHING AN ELECTRIC CONTACTOR ON AND/OR OFF

This application is a U.S. National Phase under 35 USC 371 of PCT Application No. PCT/EP2012/003308 filed Aug. 2, 2012, which claims priority to the German Patent Application No. 10 2012 013170.4 filed Jul. 2, 2012, the disclosures of which are incorporated by reference herein.

The invention relates to an electric contactor according to the preamble of independent claim 1.

Electric contactors, on the design of which highest demands are put as to their wear resistance, are in particular known from the field of railroad construction. In particular the contact regions of high-power contactors used herein are subjected to enormous strains. In the switching-on phase, when the contact regions of the contactors contact counter-contact regions, and in the switching-off phase, when the contact regions are decontacted from the counter-contact regions, high strains occur due to the high currents to be switched, in particular currents in the two-digit kiloampere range. Here, charges are transmitted between the contacts already before the contact regions rest on the counter-contact regions, as in the switching-on phase, and also still after the contact regions have been removed from the counter-contact regions, as in the switching-off phase, said transmission manifesting itself by the formation of electric arcs. Thus, very high thermal loads act on the corresponding contact regions during these switching phases. The longer and the more frequently said contact regions are subjected to such strong electric arcs, the higher the risk of the contact regions being even welded to the respective counter-contact regions is. As a consequence, the contactor will fail.

The strains on these components tend to become particularly high in relatively small designs to which very high starting currents (for example >20 kA) are to be applied, or also in multi-pole apparatus designs. Failures in technical railroad systems by welding due to short-circuit currents in the above mentioned order lead to operational failures and high consequential costs.

Arcing is further increased in these systems by oscillations occurring during contacting and decontacting in the contact mechanism due to rebound phenomena between the moving contact regions and the counter-contact regions. In the contact phase of the switching-on operation, a rebound pulse occurs after the contact regions have first impacted on the counter-contact regions due to the spatially fixed counter-contact regions. As a consequence, the contact regions are again spaced apart from the counter-contact regions resulting in further arcing in the switching-on operation (starting electric arc). This return motion will continue until the power of the magnetic field built up by the stator moves the contact regions against the counter-contact regions again. This dynamic change of the distance can even be repeated several times, thus further increasing the destructive strain on the contact regions by electric arcs. Even in a decontacting phase, during the switching-off operation, such rebound developments may occur due to the forces acting against the moving direction of the armature, such as residual attraction forces due to residual coil currents of the drive. Multiple, differently long arcing occurs in the contact zones between the contact regions and the counter-contact regions during each switching operation by the spacing-apart process that is repeatedly caused by rebound.

From GB 758782 A, an electric rotary relay is known where the rotary motion of the armature is initially used for accelerating an inertia ring disposed at the outer periphery of the armature. There is only a frictional connection between the armature and the inertia ring. When the armature abruptly comes to a standstill at the end of the switching operation, the inertia ring continues rotating whereby a torque generated by friction acts on the armature and stops the armature at the final stop.

It is the object of the present invention to reduce strain due to arcing on the contact regions of contactors and their effects, such as burning away due to electric arcs and welding risks.

According to the invention, this object is achieved by the armature being movable in the axial direction of the armature from the first to the second position during the switching-on operation and/or the switching-off operation, a pushing device being connected to the armature which is rotatable relative to the armature, the pushing device at least temporarily pushing the armature supportively during the movement from the first to the second position of the switching-on and/or switching-off operation.

Thus, the contacting and decontacting operations are essentially optimized. In contacting during the switching-on operation, pushing leads to a swift, undelayed passage through the critical contacting phase with the quickest possible build-up of the final contact force. Pushing by means of the pushing device causes the contact regions to additionally press against the counter-contact regions. The rebound tendency of the contact regions and the time until the contact regions completely contact the counter-contact regions are thus essentially reduced. On the other hand, during switching-off, too, the movement of the armature is supported whereby the contact regions are pulled away from the counter-contact regions by the pulling drive. In decontacting during the switching-off operation, pushing leads to the introduction of a high dynamic opening pulse onto the contact regions to be opened which are still at rest, which are subsequently opened at the highest possible opening speed. It is thus possible to essentially shorten the critical contacting phases and decontacting phases and thus also shorten the action of arcing. Thus, the service life of such contactors is essentially extended. But even higher currents, in particular currents of more than 20 kA that occur in case of short-circuits, may be mastered with a considerably improved reliability due to the shortening of the influence by electric arcs and the dynamic opening pulse.

Furthermore, said pushing device has the advantage that it may be linked to existing contactor designs without any complex changes in the design of the contactors geometry.

Advantageous embodiments are claimed in the subclaims and will be illustrated more in detail below.

In one advantageous embodiment, it is advantageous for the pushing device to be driven, in a first phase of the switching-on and/or switching-off operation, by the armature, and to support the movement of the armature in a second phase of the switching-on and/or switching-off operation during contacting and/or decontacting of contact region and counter-contact region. It is thus possible to drive the pushing device by the same source of energy, for example via the stator. By introducing energy into the pushing device through the armature in the first phase, a braking effect is furthermore exerted on the movement of the armature which involves, during the switching-on operation, i. e. the contacting of the contact regions with the counter-contact regions, the advantage that the impact speed of the contact regions is reduced. This results in a further reduction of the rebound tendency, thus reducing the risk of welding.

According to a further embodiment, it is advantageous for the pushing device to comprise a flywheel as thus a rotatability of the pushing device is particularly easily possible in a space-saving manner. Even the efficiency and effect of the pushing device will then not only depend on the mass of the pushing device but mainly on the rotary inertia of the flywheel mass. Thus, it is possible to optimize the flywheel weight used. Furthermore, there is no dependency on the fitting position.

If, in another embodiment, the armature and the pushing device are connected via a translation unit which translates the movement of the armature into a rotary motion of the pushing device, the movement between the pushing device and the armature is independent and the movements may be arbitrarily adapted by translation.

If in this case, the translation unit, according to a further embodiment, additionally includes a helical gearing comprising male and female threaded portions, one of said male and female threaded portions being fixed to the armature and the other one of the female and male threaded portions being fixed to the pushing device, a simple and inexpensive translation of motions may be realized.

In an additional embodiment, it would be conceivable to support the threaded portion of the translation unit fixed to the pushing device axially with respect to a housing of the contactor. Thus, the position of the pushing device both during the switching-on and the switching-off operations relative to the contactor housing is secured, in turn reducing the required space of this pushing device.

According to one embodiment, it would also be conceivable for the helical gearing not to be self-locking. Thereby, the pushing device may be arranged such that the frictional forces occurring in the helical gearing and the efficiency of the translation unit are optimized.

Advantageously, it would also be conceivable to connect the armature elastically with the contact region by means of a spring element. This elasticity of the spring element on the one hand further reduces the rebound of the contact regions during contacting and permits an elastic pretension of the contact regions to the counter-contact regions in the first or in the second position.

If this spring element, as an alternative, is compressed at least in the position in which the contact region is connected with the counter-contact region, during switching over/switching off the contactor, the force stored in the compressed spring may first drive again the pushing device in a simple manner.

According to a further variant, it would also be possible to connect the armature to the pushing device by means of a switch rod, the pushing device being rotatable relative to the switch rod. Thereby, a decoupling of the magnetizable armature from the surrounding components, in particular the pushing device and/or the spring element, may be realized. If the switch rod is made of a non-magnetic material, magnetic losses by a stray field parallel to the useful field are avoided.

It would also be advantageous for the moving direction of the armature between the first and the second positions to correspond, as an alternative, to the axial direction of the switch rod. Thus, a defined guidance of the armature from the first position to the second position and vice-versa would be possible.

Furthermore, a method for switching-on and/or switching-off an electric contactor is contained, comprising the following steps:

a) moving an armature by activating and/or deactivating a stator,
b) accelerating a rotation of a pushing device, the pushing device being connected to the armature, and
c) transmitting at least a portion of the kinetic energy of the pushing device to the armature in a phase of the switching-on and/or switching-off operation in which a contact region connected with the armature contacts or decontacts a counter-contact for supporting the armature movement.

Thereby, a particularly efficient action of contactors is possible.

This efficiency may be further increased if in a second phase, the armature transmits kinetic energy to the pushing device for driving the rotation of the pushing device.

The invention will be illustrated more in detail below with reference to a drawing.

FIG. 2 shows the electric contactor shown in FIG. 1 in a second, closed position when the stator is switched on.

Figure 1:
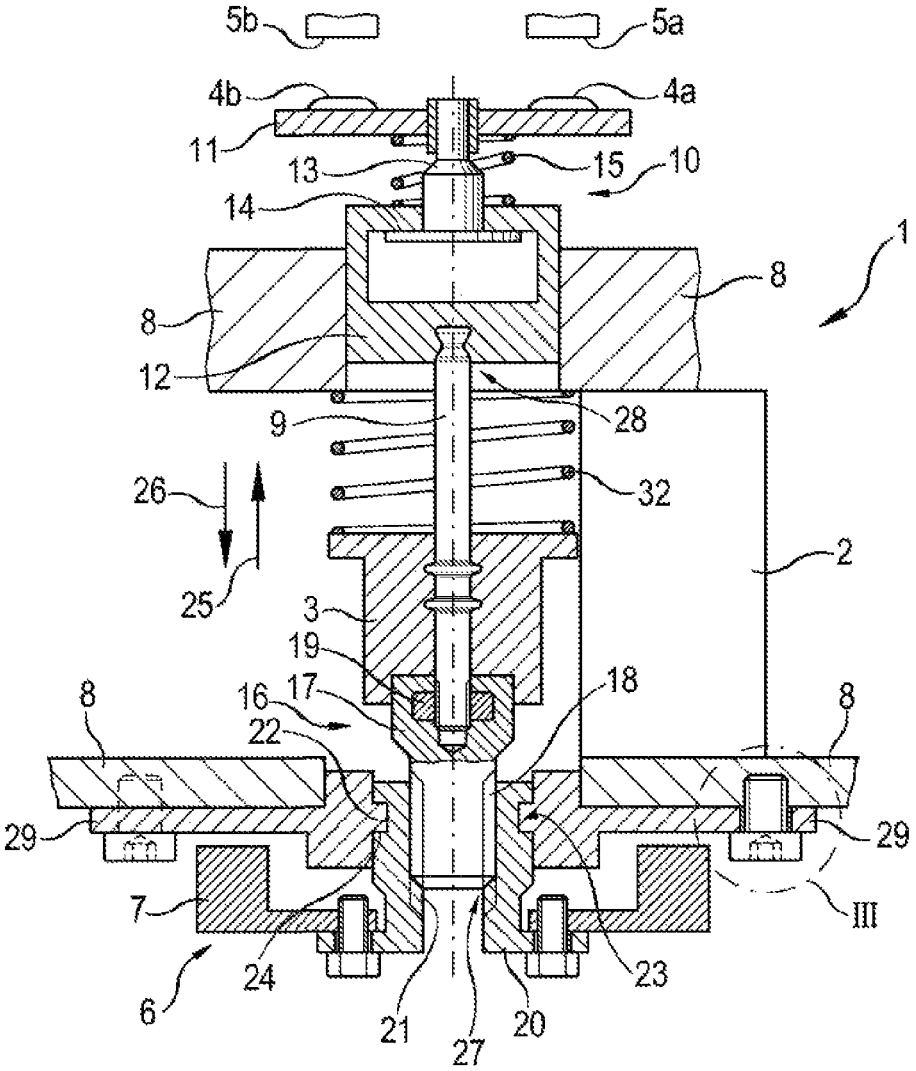
FIG. 1 shows an electric contactor according to the invention in a sectional view along the moving direction of the armature in a first, opened position when the stator is switched off.
Figure 2:
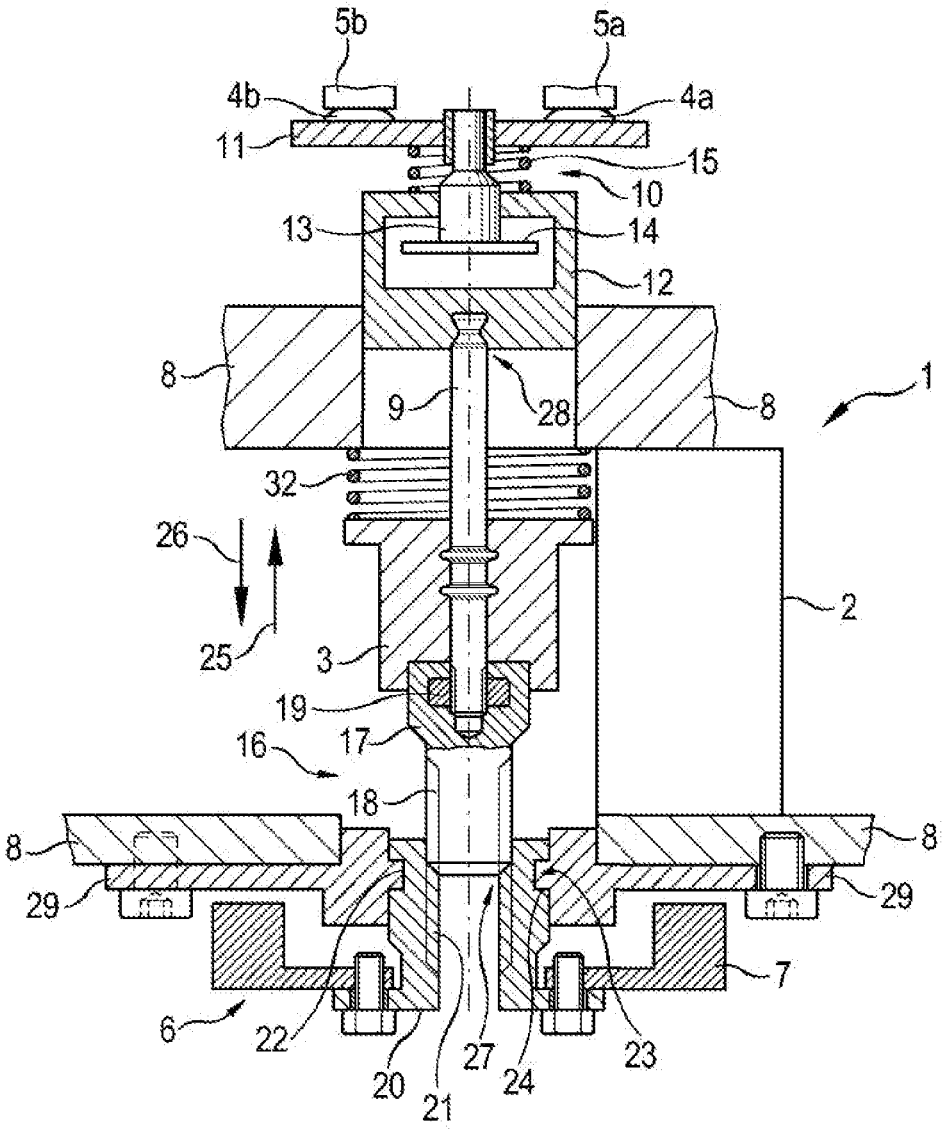
Figure 4:
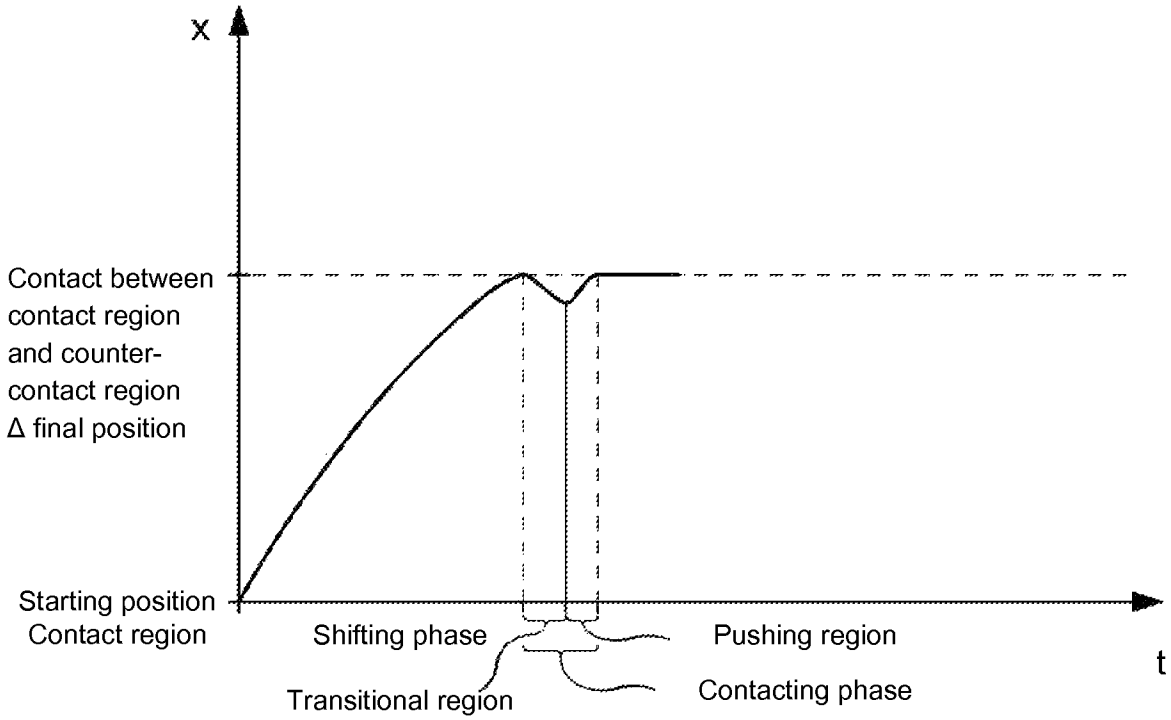

FIG. 4 furthermore shows the procedure when a contactor according to the invention is being switched on, that means when it is switched over from the opened position shown in FIG. 1 to the closed position shown in FIG. 2.

Figure 5:
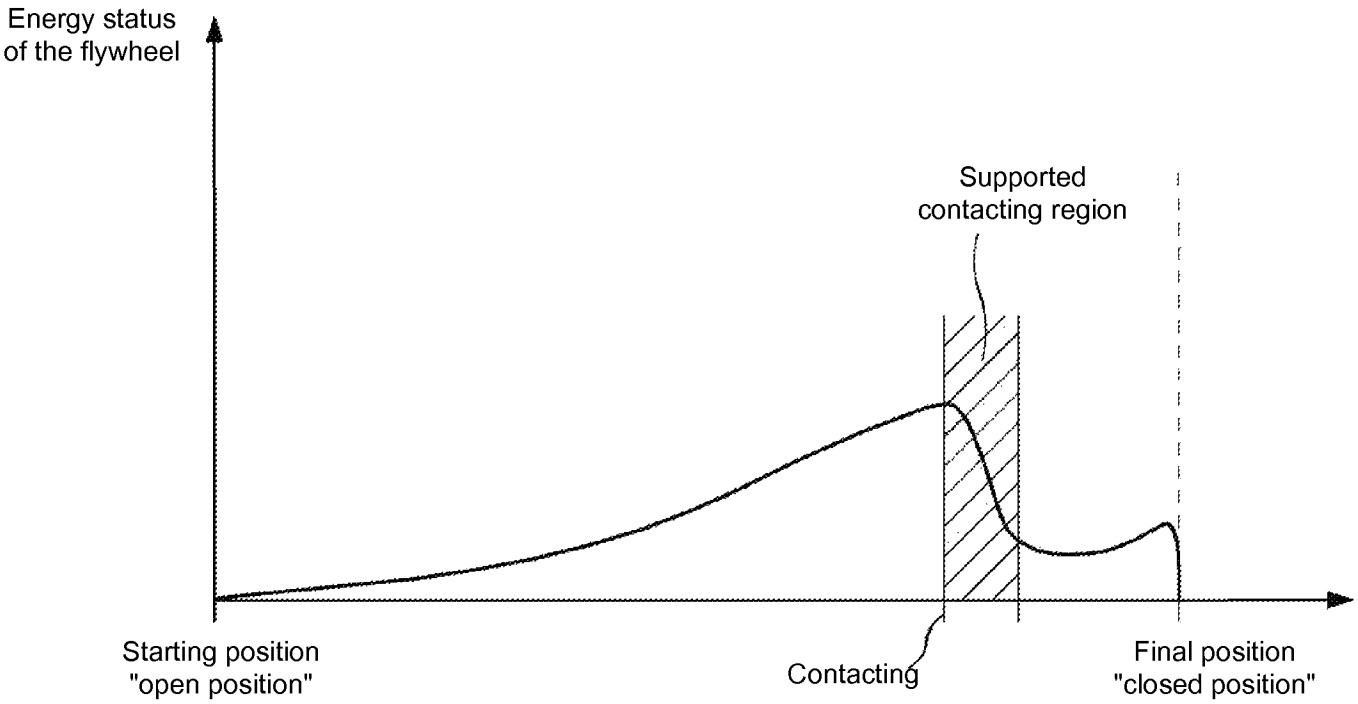

FIG. 5 shows a graph in which the energy state of the flywheel is shown during switchover from the opened position to the closed position.

For identical elements of the invention or elements having the same effect, identical reference numerals are used. The represented embodiments only show examples of how the device according to the invention or the method according to the invention could be designed, they do not constitute any conclusive limitation.

FIGS. 1 and 2 show the electric contactor 1 according to the invention comprising a stator 2 and an armature 3 movable relative to the latter, the armature 3 being connected with at least one contact region 4*a* or 4*b*, preferably two contact regions 4*a* and 4*b*. These contact regions 4*a* and 4*b* may each be connected with a preferably stationary counter-contact region 5*a* and 5*b*. Moreover, a pushing device 6 designed as a flywheel 7 is connected to the armature 3.

The stator 2 positioned laterally of the armature 3 is firmly connected with a housing 8 of the electric contactor 1. The activation and supply of the stator 2, which may comprise, for example, an economy switch as will be described more in detail below, are moreover not represented here. The stator 2 cooperates with the movable armature 3 via a magnetic field built up after the stator 2 has been switched on. When the stator 2 is switched off, the armature 3 and the contact regions 4*a* and 4*b* connected with the latter are first in the open position of the contactor 1 shown in FIG. 1. In this open position, the armature 3 is not influenced by the magnetic field of the stator 2, so that the contact regions 4*a* and 4*b* are spaced apart from the counter-contact regions 5*a* and 5*b* and separated from each other electrically. After the stator 2 has been switched on, the armature 3 and the contact regions 4*a* and 4*b* connected with it are pushed into the closed position of the contactor 1 shown in FIG. 2 due to the force of the magnetic field of the stator 2. In this closed position, the contact regions 4*a* and 4*b* are lying against the counter-contact regions 5*a* and 5*b* and are thus electrically conductively connected to the counter-contact regions 5*a* and 5*b*.

In the embodiment shown in FIGS. 1 and 2, the armature 3 is fixed to a switch rod 9. Said switch rod 9 is preferably made of a non-magnetic and not magnetizable material. Moreover, the switch rod 9 is mounted in the housing 8 such that, after the stator 2 has been switched on, the armature 3 performs the sliding motion 25 from the first into the second position along the axial direction of the switch rod 9. As an alternative to the axial movement of the armature 3 represented here, the armature 3 may also be rotationally moved from a first to a second position.

At a first end 28 of the switch rod 9, between the armature 3 and the contact regions 4*a* and 4*b*, a guide section 12 is furthermore provided which guides the movement of the switch rod 9 relative to the housing 8. To this end, the guide section 12 is lying against the housing 8 via flanks by means of which the guide section is guided along the housing during the movement from the first into the second position. A spring element 10 is furthermore arranged at this guide section 12 which establishes an elastic connection between the switch rod 9 and the contact regions 4*a* and 4*b*. The spring element 10 on the one hand comprises a coil spring 15 which is lying with one end against a support face of the guide section 12 and with another end against a support face of a contact support 11, the contact support 11 receiving the contact regions 4*a* and 4*b*. For stabilizing the coil spring 15, the spring element 10 on the other hand comprises a guide tappet 13. Said guide tappet 13 is disposed in the direction of the longitudinal axis of the coil spring 15 and connected to the contact bridge 11 and the guide section 12. On the side of the guide section 12, the guide tappet 13 is axially movably mounted at the latter. As can be taken from FIGS. 1 and 2, the longitudinal axis of the coil spring 15 is preferably coaxial to the longitudinal axis of the guide tappet 13. The axial moving direction of the guide section 12 relative to the housing 8 also corresponds to the axial moving directions 25 and 26 of the armature 3 and the switch rod 9.

The guide tappet 13 designed as a rigid element at a first end comprises a locating flank 14 which is lying against a counter-surface of the guide section 12 in the opened position of the contactor 1. At a second end of the guide tappet 13 opposite to said first end, the guide tappet 13 is firmly connected to the contact support 11, for example via a threaded joint.

The length of the guide tappet 13 and the geometry of the coil spring 15 are selected such that the coil spring 15 is tensioned to a certain degree even in the opened position and maintains the distance between the contact support 11 and the guide section 12 in the open position.

The pushing device 6 is also connected to the armature 3. As is shown in FIGS. 1 and 2, a translation unit 16 is connected to the switch rod 9, the translation unit 16 in turn connecting the pushing device 6 to the armature 3 and holding the pushing device 6 so as to be rotatable relative to the armature 3.

Said translation unit 16 comprises a helical gearing 27 which includes a pin 17 comprising a male threaded portion, hereinafter referred to as external thread 18, and a receiving part 20 comprising a female threaded portion, hereinafter referred to as internal thread 21. The pin 17 whose external thread 18 has a helical design is preferably secured against rotation relative to the switch rod 9 by a hexagon bolt 19 connected to the switch rod 9. The internal thread 21 engages the external thread 18. As can be seen in FIGS. 1 and 2, while the armature 3 is being moved from the open position to the closed position, the pin 17 is moved along corresponding to the moving direction of the armature 3. The receiving part 20 has a rotationally symmetric section which is rotationally mounted in a flange 29. For the axial positioning of the receiving part 20, the receiving part 20 is axially mounted in the flange 29 and thus to the housing 8 and is thus not axially shifted during switching operations. For the purposes of this mounting, a slide face 22 of the flange 8 is provided with a projection 23 which engages a recess 24 of the receiving part 20.

Figure 3:
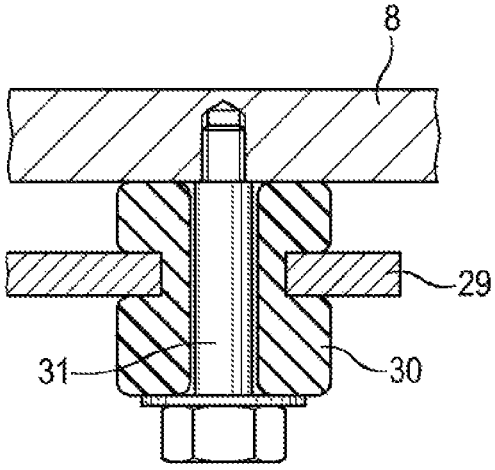
FIG. 3 shows, in a detailed view, a further embodiment of the connection of the flange to the housing shown in FIG. 1 in a sectional representation.

The flange 29 is firmly connected with the housing 8 via mounting screws, here with the bottom side of the housing 8. In this embodiment, the flange 29 is directly fixed to the housing via several mounting screws. As an alternative, and as is shown in the embodiment of FIG. 3, a damping element 30 may also be additionally arranged between the housing 8 and the flange 29. Said damping element 30 is at least partially disposed between the flange 29 and the housing 8 and thus prevents the flange 29 from directly resting on the housing 8 in the region of the mounting points. In this embodiment, the damping element 30 has an essentially cylindrical design, where the flange 29 engages in a circular recess at the outside of said damping element 30. The damping element 30 furthermore has a central bore inside in which a fit screw 31 is arranged in sections and rests with its screw head against the damping element 30. Said fit screw 31 is engaged with a threaded pin section in an internal thread of the housing 8. A shank section of the fit screw 31 passing from the screw head to the threaded section predetermines the length of the damping element 30. The front face of the shank section rests against the housing 8 and tensions the damping element 30, which preferably consists of rubber, between the screw head of the fit screw 31 and the housing 8. This damping element 30 in particular has a damping effect at the stops in the final positions of the armature 3 during the switching-on and switching-off operations and thus reduces the strain on the bearing between the receiving part 20 and the flange 29 and the strain within the helical gearing 27 between the pin 17 and the receiving part 20. Thus, force peaks are considerably dampened.

As can be further seen in FIGS. 1 and 2, the receiving part 20 is preferably fixed to the flywheel 7 of the pushing device 6 via screws.

The helical gearing 27 between the pin 17 and the receiving part 20 is designed, in particular in view of the thread pitch, such that, when the armature 3 is being moved, the armature's movement—in the concrete design the axial movement of the armature 3—is translated into a rotary motion of the flywheel 7. Here, this helical gearing 27 is not self-locking and/or has a thread pitch of preferably between 25° and 35°, in particular 30°. The thread is preferably a single-flight thread.

In the embodiment of FIGS. 1 and 2, a readjusting spring 32 is furthermore provided as additional opening support. This readjusting spring 32 presses with a first spring end against a section of the housing 8 and with a second end opposed to the first spring end against a section of the armature 3. In the open position of the contactor 1 shown in FIG. 1, this readjusting spring 32 presses the armature 3 and thus the guide section 12 and the contact regions 4*a* and 4*b* connected therewith into the opened position. If the contactor 1 is switched on and the armature 3 is shifted to the top into a contacting position, the readjusting spring 32 is tensioned to a greater extent. By this contraction of the readjusting spring 32 in the switched-on state, there is thus a supporting spring force available when the contactor 1 is switched off again, said spring force pressing the armature 3 and thus the guide section 12 back into the open position and supporting the opening procedure during the switching-off operation by the additional spring force.

It is advantageous for the central axis of the helical gearing 27 and thus of the external thread 20 and the internal thread 21, as shown in FIGS. 1 and 2, to be designed along the axial moving directions 25 and 26 of the armature 3. Moreover, the axis of rotation of the flywheel 7 is preferably embodied coaxially to the central axis of the threaded joint 27 and the axial moving directions 25, 26 of the switch rod 9 as thus side forces may be reduced. The guide tappet 13 and/or the coil spring 15 are also oriented with their longitudinal axes and central axes along the moving directions 25 and 26 to reduce side forces on the coil spring 15.

Below, the functioning of the concrete embodiment will be described with reference to FIGS. 4 and 5:

If in a switching-on operation of the contactor 1, the stator 2 is supplied with power, the armature 3 will, due to the magnetic force of the stator 2, be shifted along the axial direction of the switch rod 9 into a first moving direction 25 represented by the arrow 25. During this shifting process, the flywheel 7 of the pushing device 6 is simultaneously rotationally driven by the coupling of the switch rod 9 and the armature 3 to the translation device 16 and to the pushing device 6. The direction of rotation of the flywheel 7 here depends on the spindle design of the pin 17, that means whether the spindle has a right-handed thread or a left-handed thread. By shifting the armature 3, the contact regions 4*a* and 4*b* are also shifted into the moving direction 25. If in the contacting phase, the contact regions 4*a* and 4*b* finally contact the counter-contact regions 5*a* and 5*b*, the coil spring 15 of the spring element 10 is compressed and its tension increased. In the process, the guide tappet 13 is shifted relative to the guide section 12, and its locating flank 14 will move away from the counterface of the guide section 12. The distance between the guide section 12 and the contact support 11 will be reduced.

As can be seen in FIG. 4, in the switching-on operation, the movement of the armature 3 is slowed down by the impact on the stationary counter-contact regions 5*a* and 5*b* in the phase of contacting. In the process, the flywheel 7 continues rotating at constant speed in a short transitional region until the flank of the internal thread 21 touching the external thread 18 has passed over to the opposite flank of screw thread. By the energy previously supplied to the flywheel 7, the energy stored there is in this phase utilized by the flywheel 7 which becomes a drive of the movement of the armature 3 due to the inertial force of the rotational mass. Thus, the armature's movement is reinforced in the direction of the first moving direction 25. The contact regions 4*a* and 4*b* are more strongly pressed against the counter-contact regions 5*a* and 5*b* due to this additional drive force until the flywheel 7 is slowed down by the spring force that is increasing with the compression of the spring element 10. Finally, the contact regions 4*a* and 4*b* are firmly connected with the counter-contact regions 5*a* and 5*b* in a final position, where the coil spring 15 is compressed by the magnetic force of the stator 2 acting in this switched-on position, and the armature 3 is held in a constrained position which differs from the position in a switched-off state.

If the contactor 1 is now switched off, the magnetic field of the stator 2 is first removed in this switching operation due to the interruption of the coil current of the stator 2. Subsequently, when the action of force of the magnetic field on the constrained position of the armature 3 is no longer sufficient, the coil spring 15 of the spring element 10 is relieved on the one hand and thereby presses the guide section 12 away from the contact support 11 until the locating flank 14 of the guide tappet 13 comes to rest again at the counterface of the guide section 12. In this relieve of the spring element 10, the switch rod 9 and the armature 3 are moved into a second moving direction 26 which is opposed to the first moving direction 25 of the switching operation. On the other hand, the spring force of the readjusting spring 32 also acts in the moving direction 26 for reinforcing the armature's movement. By this relieve of the coil spring 15 and the readjusting spring 32, the flywheel 7 of the pushing device 6 is in turn rotationally driven. In this case, the rotation of the flywheel 7 is opposed to the rotation of the switching-on operation. When the coil spring 15 is maximally relieved and thus the stored spring energy has been at least partially translated into the rotary motion of the flywheel 7, in the subsequent phase of decontacting, the inertia of the flywheel mass will act again as a drive for the movement of the armature 3. The contact regions 4*a*, 4*b* are separated from the counter-contact regions 5*a* and 5*b* by the thrust of the flywheel 7 acting in the direction of the second moving direction 26 of the armature 3. Thus, the flywheel 7 is also used for supporting decontacting during the switching-off operation.

As can be furthermore seen in FIG. 5, during the switching operation from the open position into the closed position, the energy of the flywheel 7 is translated into the movement of the armature 3 to cause the contact regions 4*a* and 4*b* to be pressed on. According to FIG. 5, the flywheel 7 initially constantly takes up energy by the acceleration of the flywheel mass, where a maximum of energy is reached shortly before the first contact of the contact regions 4*a* and 4*b* with the counter-contact regions 5*a* and 5*b*. After this first contact of the contact regions 4*a* and 4*b* and the counter-contact regions 5*a* and 5*b*, the flywheel 7 supportively acts on the contact regions 4*a* and 4*b* by giving off the kinetic energy stored in its rotation again to the axial movement of the armature 3 by means of the helical gearing 27. In the process, energy is withdrawn from the flywheel 7, and the armature 3 and the contact regions 4*a* and 4*b* are pressed against the counter-contact regions 5*a* and 5*b*. After the spring element 10 and the readjusting spring 32 have been maximally compressed and the movement of the armature 3 towards the counter-contact regions 5*a* and 5*b* is stopped, due to the elasticity of these spring systems and the receiving components connected to the counter-contact regions 5*a* and 5*b*, a short springback opposite to the moving direction of the armature 3 occurs, which temporarily causes again an energy return to the flywheel 7 until the armature 3 finally reaches its stable final position.

As mentioned above, the stator 2 may be connected to an economy switch. Directly after being switched on, such economy switch provides a high starting power of about 200 W which is clearly higher than the later retaining power to quickly build up the magnetic field and transmit a sufficiently high acceleration force to the masses of the armature 3 and the flywheel 7 of the pushing device 6 connected therewith. After the contact regions 4*a* and 4*b* have been contacted with the counter-contact regions 5*a* and 5*b*, the lower retaining power is returned to as then only the armature 3 and the spring element 10 are required to be retained. Energy efficiency may thus be additionally increased.

The invention claimed is:

1. An electric contactor, in particular to be used in roadways, comprising:

a stator;

an armature, the armature being connected with a contact region and movable in an axial direction of the armature, during a switching-on operation and/or a switching-off operation of the contactor, from a first to a second position, the contact region being connected, in at least one of the positions, with a counter-contact region for closing an electric circuit;

a pushing device, comprising a flywheel, the pushing device being rotatable relative to the armature, and the pushing device at least temporarily pushing the armature supportively during the movement from the first to the second position of the switching-on and/or switching-off operation; and a translation unit, wherein the armature and the pushing device are connected to one another via the translation unit, wherein the translation unit comprises a helical gearing with a male threaded portion and a female threaded portion, one of the threaded portions being connected with the armature, and the other threaded portion being connected with the pushing device, wherein the threaded portion of the helical gearing connected with the pushing device is held axially with respect to a housing of the contactor, wherein the helical gearing is configured such that the axial movement of the armature is translated into a rotational movement of the pushing device, wherein the helical gearing is not self-locking.

2. The electric contactor according to claim 1, wherein the pushing device is driven, in a first phase of the switching-on and/or the switching-off operation, by the armature, and supports, in a second phase of the switching-on and/or the switching-off operation, the movement of the armature during contacting and/or decontacting of the contact region and the counter-contact region.

3. The electric contactor according to claim 1, wherein the armature is elastically connected with the contact region by means of a spring element.

4. The electric contactor according to claim 3, wherein the spring element is compressed in at least one of the first and second positions.

5. The electric contactor according to claim 1, wherein the armature is connected to the pushing device by means of a switch rod, the pushing device being rotatable relative to the switch rod.

6. The electric contactor according to claim 5, wherein the moving direction of the armature between the first and the second positions is the axial direction of the switch rod.

7. The electric contactor according to claim 1, wherein the helical gearing has a thread pitch of between 25° and 35°.

8. The electric contactor according to claim 1, wherein the helical gearing has a single-flight thread.

9. A method of switching-on and/or switching-off an electric contactor, the electric contactor comprising a stator; an armature, the armature being connected with a contact region, and the armature being movable from a first position to a second position; a pushing device, the pushing device comprising a flywheel and being rotatable relative to the armature; and a translation unit, wherein the armature and the pushing device are connected to one another via the translation unit, wherein the translation unit comprises a helical gearing with a male threaded portion and a female threaded portion, one of the threaded portions being connected with the armature, and the other threaded portion being connected with the pushing device, wherein the threaded portion of the helical gearing connected with the pushing device is held axially with respect to a housing of the contactor, wherein the helical gearing is not self-locking, the method comprising:

a) moving the armature in an axial direction of the armature from the first position to the second position by activating and/or deactivating the stator, b) accelerating a rotation of the pushing device, c) transmitting at least a portion of the kinetic energy of the pushing device to the armature in a phase of the switching-on and/or switching-off operation in which the contact region contacts or decontacts a counter-contact region, the pushing device thereby at least temporarily pushing the armature supportively during the movement from the first position to the second position, wherein the contact region is connected in at least one of the first and the second positions with the counter-contact region to thereby close an electric circuit, and d) translating the axial movement of the armature into a rotational movement of the pushing device by the helical gearing.

10. The method according to claim 9, wherein the armature transmits in a first phase kinetic energy to the pushing device, wherein the phase of the switching-on and/or switching-off operation for supporting the armature movement, in which a contact region connected with the armature contacts or decontacts the counter-contact region, corresponds to a second phase.

* * * * *